US010428457B2

(12) United States Patent
Planeta

(10) Patent No.: US 10,428,457 B2
(45) Date of Patent: Oct. 1, 2019

(54) METHOD AND APPARATUS FOR MANUFACTURING WATERMARKED PAPER

(71) Applicant: FEDRIGONI S.P.A., Verona (IT)

(72) Inventor: Ivo Planeta, Rome (IT)

(73) Assignee: FEDRIGONI S.P.A., Verona (IT)

( * ) Notice: Subject to any disclaimer, the term of this patent is extended or adjusted under 35 U.S.C. 154(b) by 96 days.

(21) Appl. No.: 15/526,800

(22) PCT Filed: Nov. 12, 2015

(86) PCT No.: PCT/EP2015/076398

§ 371 (c)(1),
(2) Date: May 15, 2017

(87) PCT Pub. No.: WO2016/075220

PCT Pub. Date: May 19, 2016

(65) Prior Publication Data

US 2018/0251943 A1 Sep. 6, 2018

(30) Foreign Application Priority Data

Nov. 14, 2014 (IT) ..... VR2014A0282

(51) Int. Cl.

| | |
|---|---|
| ***D21F 1/44*** | (2006.01) |
| ***D21F 9/00*** | (2006.01) |
| ***D21F 9/04*** | (2006.01) |
| ***D21F 11/08*** | (2006.01) |

(Continued)

(52) U.S. Cl.

CPC ..... *D21F 1/44* (2013.01); *D21F 9/006* (2013.01); *D21F 9/043* (2013.01); *D21F 9/046* (2013.01); *D21F 11/08* (2013.01); *D21H 21/40* (2013.01); *D21H 21/42* (2013.01)

(58) Field of Classification Search

USPC ..... 162/110

See application file for complete search history.

(56) References Cited

U.S. PATENT DOCUMENTS

2009/0001709 A1 1/2009 Kretschmar et al.

FOREIGN PATENT DOCUMENTS

DE 102005045566 A1 9/2006
WO WO 2014/086476 A1 6/2014

OTHER PUBLICATIONS

WO 2014/086476, Tantscher et al., machine translation, Jun. 2014.*

(Continued)

*Primary Examiner* — Mark Halpern

(74) *Attorney, Agent, or Firm* — Scully, Scott, Murphy & Presser, P.C.

(57) ABSTRACT

A method for manufacturing watermarked paper, comprising:

a step of forming a first fibrous panel which comprises at least one watermark element;

a step of forming a second, thin fibrous panel;

a step of removal, by way of suction, of at least one portion of the second, thin fibrous panel in order to produce a localized reduction in thickness at a first face of the second, thin fibrous panel, so as to provide at least one accommodation seat intended to accommodate a security element;

a step of coupling between the first fibrous panel and the face of the second, thin fibrous panel which lies opposite the first face.

11 Claims, 2 Drawing Sheets

(51) Int. Cl.
*D21H 21/42* (2006.01)
*D21H 21/40* (2006.01)

(56) References Cited

OTHER PUBLICATIONS

International Search Report and Written Opinion dated Jan. 22, 2016 issued in PCT/EP2015/076398.
Italian Search Report and Written Opinion dated Mar. 24, 2015 issued in IT VR20140282, with partial translation.

* cited by examiner

METHOD AND APPARATUS FOR MANUFACTURING WATERMARKED PAPER

This application is a 371 of PCT/EP2015/076398 filed Dec. 11, 2015

The present invention relates to a method and an apparatus for manufacturing watermarked paper.

Elements are known in watermarked paper which are associated with holographic strips and screen-printed strips, which have a certain thickness.

Such strips, when they are applied to paper, generate localized regions of greater thickness on each sheet, such that the reams are not perfectly flat, but are instead rather corrugated.

The aim of the present invention is to make available a method and an apparatus for manufacturing watermarked paper which are capable of solving the above mentioned problem.

Within this aim, an important object of the present invention is to devise a method and an apparatus for manufacturing watermarked paper which are adapted to allow the application of holographic strips and screen-printed strips without resulting in an additional thickness on the reams.

This aim and these and other objects which will become better apparent hereinafter are achieved by a method and an apparatus for manufacturing watermarked paper according to the present invention.

Further characteristics and advantages of the invention will become better apparent from the description of some preferred, but not exclusive, embodiments of a method and of an apparatus for manufacturing watermarked paper according to the present invention, which are illustrated by way of non-limiting examples in the accompanying drawings wherein.

In the embodiments illustrated, individual characteristics shown in relation to specific examples may in reality be interchanged with other, different characteristics, existing in other embodiments.

The present invention relates to a method for manufacturing watermarked paper, comprising:

- a step of forming a first fibrous panel 1 which comprises at least one watermark element;
- a step of forming a second, thin fibrous panel 2;
- a step of removal, by way of suction, of at least one portion of the second, thin fibrous panel 2 in order to produce a localized reduction in thickness at a first face 2*a* of the second, thin fibrous panel 2, so as to provide at least one accommodation seat 2*b* intended to accommodate a security element;
- a step of coupling between the first fibrous panel 1 and the face of the second, thin fibrous panel 2 which lies opposite the first face 2*a*.

Advantageously, the method according to the invention comprises, between the step of forming the second, thin fibrous panel 2 and the step of coupling between the first fibrous panel 1 and the face of the second, thin fibrous panel 2 which lies opposite the first face, a step of temporary coupling of the first face 2*a* of the second, thin fibrous panel 2 to a coupling face 3*a* of a ribbon-like element 3.

Conveniently, the ribbon-like element 3 comprises a microporous body (sheet) which is associated, on the opposite side with respect to the coupling face 3*a*, with a suction element which is adapted to ensure the temporary adhesion of the first face 2*a* of the second, thin fibrous panel 2 to the coupling face 3*a* of the ribbon-like element 3.

Conveniently, the step of forming the first fibrous panel 1 is performed by way of a forming screen 4.

Figure 1:
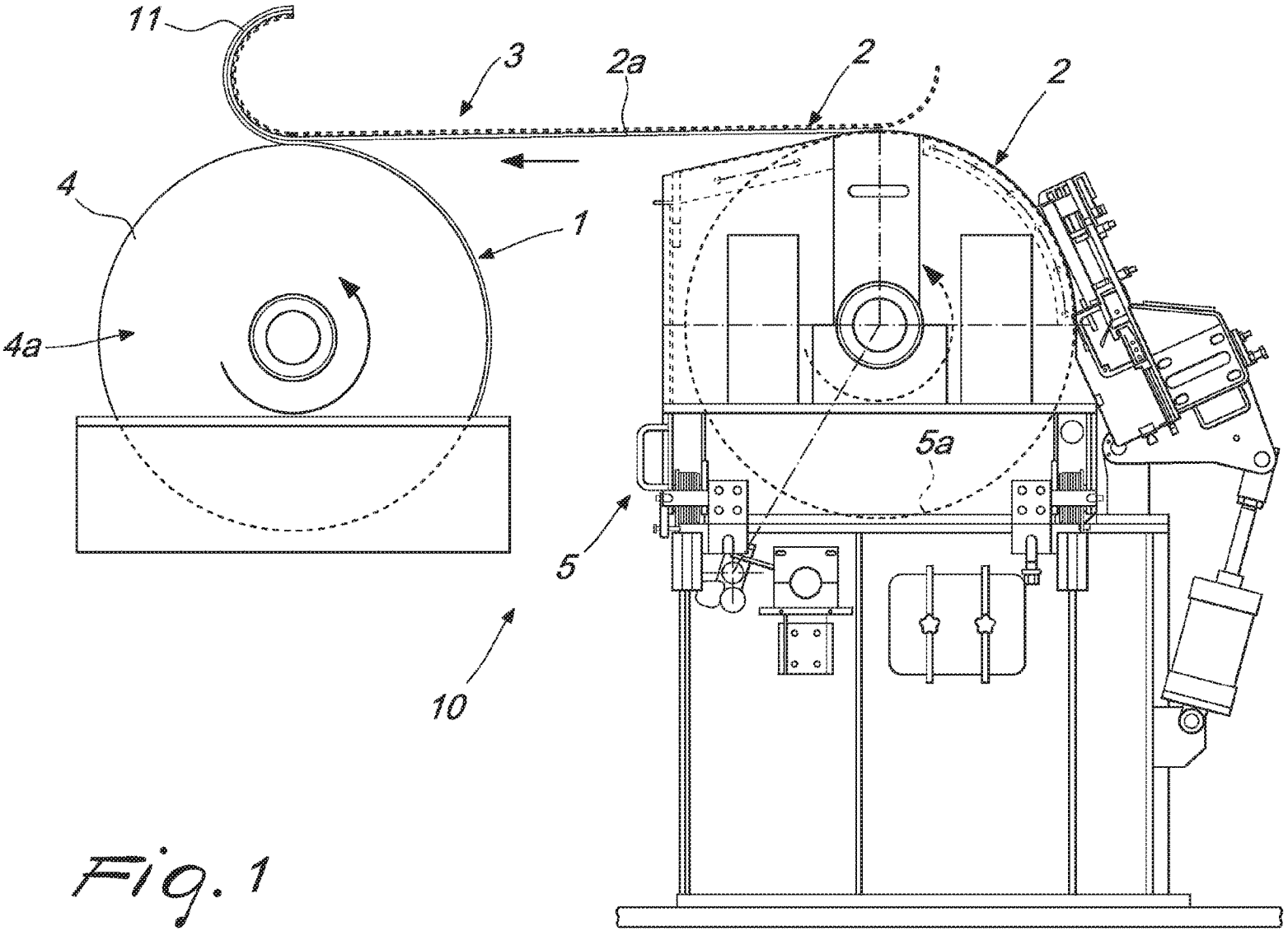
FIG. 1 is a side elevation view of the apparatus according to the invention.
Figure 2:
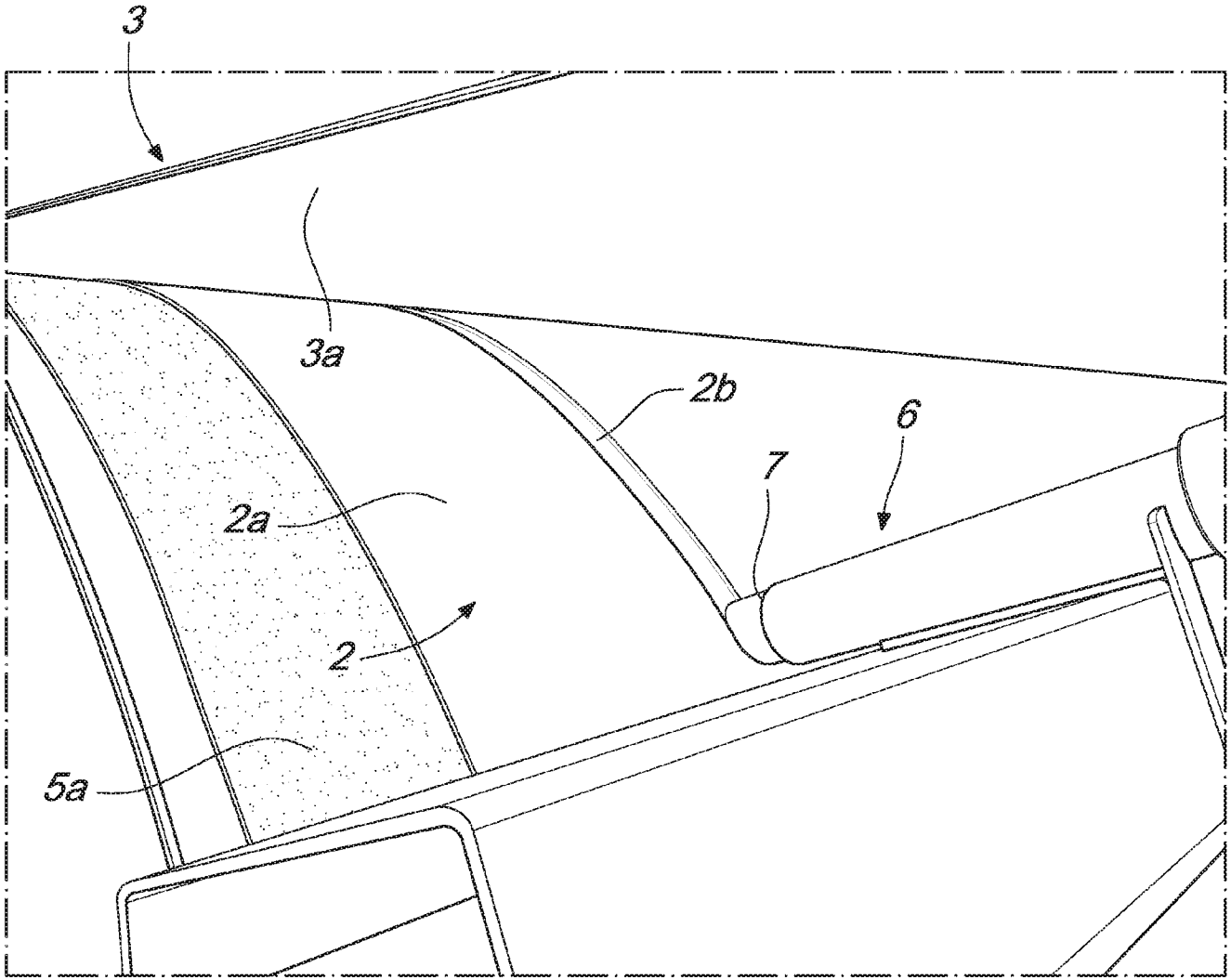
FIG. 2 is a perspective view of the suction means.

With reference to the type of apparatus 1 shown schematically in FIG. 1, the forming screen 4 is defined on the lateral surface of a forming drum 4*a* which has a lower forming portion arranged inside a forming tank, containing the paper pulp, and an upper forming portion for forming the first fibrous panel 1.

Delving deeper into the details, the step of forming the second fibrous panel 2 is performed by way of a so-called former 5.

Such former 5 can have a closed element 5*a* which defines a surface for depositing the paper pulp.

Along its extension, and in particular downstream, with respect to the direction of advancement, of the region where the paper pulp is deposited, there are suction means 6 which are adapted to perform the step of removal, by way of suction, of at least one portion of the second, thin fibrous panel 2 in order to produce a localized reduction in thickness.

It has been found to be particularly advantageous if the first fibrous panel 1 has the same composition as the second, thin fibrous panel 2.

For this reason, it will be advisable to use the same type of paper pulp to feed both the forming screen 4 and the former 5.

Advantageously, the step of suction is obtained by way of suction means 6 which comprise a suction head 7.

Conveniently, the method comprises a step of associating at least one security element at the accommodation seat 2*b*. Such step can optionally be performed after the production of the roll of paper, as well.

Preferably, the security element has a height which substantially corresponds to the height extension of the accommodation seat 2*b*.

For the purposes of example, the security element comprises a holographic strip, a screen-printed strip or the like.

Advantageously, the microporous body (sheet) is made substantially of plastics.

According to a further aspect, the present invention relates to an apparatus 10 for manufacturing watermarked paper 11.

The apparatus 10 comprises a forming screen 4 for the provision of a first fibrous panel 1 which has at least one watermark element, and a former 5 for the provision of a second, thin fibrous panel 2.

The apparatus 10 according to the invention comprises means of removal, by way of suction means 6, of at least one portion of the second, thin fibrous panel 2 in order to produce a localized reduction in thickness at a first face 2*a* of the second, thin fibrous panel 2, so as to provide at least one accommodation seat 2*b* intended to accommodate a security element.

The apparatus 10 comprises, further, means of coupling between the first fibrous panel 1 and the face of the second, thin fibrous panel 2 which lies opposite to the first face 2*a*.

Advantageously, the apparatus 10 comprises a ribbon-like element 3 which defines a coupling face 3*a*.

In particular, means are provided for the temporary coupling of the first face 2*a* of the second, thin fibrous panel 2 to the coupling face 3*a*.

Conveniently, the ribbon-like element 3 comprises a microporous body which is associated, on the opposite side with respect to the coupling face 3*a*, with a suction element (not shown in the figures), which is adapted to ensure the temporary adhesion of the first face 2*a* of the second, thin fibrous panel 2 to the coupling face 3*a* of the ribbon-like element 3.

For the purposes of example, the suction means 6 comprise at least one suction head 7.

The suction head or heads 7 can, advantageously, be moved with respect to a support in order to make it possible to provide the accommodation seats 2*b* at different positions.

Preferably, moving the suction head or heads 7 with respect to the respective support involves at least one transverse component with respect to the advancement direction of the second, thin fibrous panel 2.

The invention, thus conceived, is susceptible of numerous modifications and variations, all of which are within the scope of the appended claims.

In practice it has been found that in all the embodiments the invention has achieved the intended aim and objects.

The dimensions, the materials employed, and the contingent shapes may be any according to requirements.

Moreover, all the details may be substituted by other, technically equivalent elements.

The disclosures in Italian Patent Application No. VR2014A000282 from which this application claims priority are incorporated herein by reference.

The invention claimed is:

1. A method for manufacturing watermarked paper, comprising:

a step of forming a first fibrous panel which comprises at least one watermark element;

a step of forming a second, thin fibrous panel;

a step of removal, by way of suction, of at least one portion of said second, thin fibrous panel in order to produce a localized reduction in thickness at a first face of said second, thin fibrous panel, so as to provide at least one accommodation seat intended to accommodate a security element, said step being performed before the second, thin fibrous panel is coupled to a ribbon-like element;

a step of coupling between said first fibrous panel and a face of said second, thin fibrous panel which lies opposite said first face.

2. The method according to claim 1, further comprising, between said step of forming said second, thin fibrous panel and said step of coupling between said first fibrous panel and the face of said second, thin fibrous panel which lies opposite said first face, a step of temporary coupling of said first face of said second, thin fibrous panel to a coupling face of the ribbon-like element.

3. The method according to claim 2, wherein said ribbon-like element comprises a microporous body which is associated, on the opposite side with respect to said coupling face, with a suction element which is adapted to ensure a temporary adhesion of said first face of said second, thin fibrous panel to said coupling face.

4. The method according to claim 3, wherein said microporous body is made substantially of plastics.

5. The method according to claim 1, wherein said step of forming said first fibrous panel is performed by way of a forming screen.

6. The method according to claim 1, wherein said step of forming said second, thin fibrous panel is performed by way of a former.

7. The method according to claim 1, wherein said first fibrous panel has the same composition as said second, thin fibrous panel.

8. The method according to claim 1, wherein said removal step is obtained by way of suction means which comprise at least one suction head.

9. The method according to claim 1, further comprising a step of associating at least one security element at said at least one accommodation seat.

10. The method according to claim 1, wherein said security element has a height that corresponds substantially to a height of said accommodation seat.

11. The method according to claim 1, wherein said security element comprises a holographic strip, a screen-printed strip or the like.

* * * * *